US008011201B2

(12) United States Patent
Brown et al.

(10) Patent No.: US 8,011,201 B2
(45) Date of Patent: Sep. 6, 2011

(54) REFRIGERATION SYSTEM MOUNTED WITHIN A DECK

(75) Inventors: Andrew Brown, Anderson, SC (US); Wendell Morris, Asheville, NC (US); Todd Swift, Weaverville, NC (US); Thomas White, Fletcher, NC (US)

(73) Assignee: Thermo Fisher Scientific (Asheville) LLC, Asheville, NC (US)

( * ) Notice: Subject to any disclaimer, the term of this patent is extended or adjusted under 35 U.S.C. 154(b) by 0 days.

(21) Appl. No.: 12/570,480

(22) Filed: Sep. 30, 2009

(65) Prior Publication Data

US 2011/0072837 A1 Mar. 31, 2011

(51) Int. Cl.
*F25D 19/00* (2006.01)

(52) U.S. Cl. ..... 62/298; 62/355

(58) Field of Classification Search ..... 62/298, 62/335, 199, 175, 440, 509, 510, 512; 165/166, 165/167, 140

See application file for complete search history.

(56) References Cited

U.S. PATENT DOCUMENTS

| | | | | |
|---|---|---|---|---|
| 2,402,921 | A | 6/1946 | Sharpe | |
| 2,462,279 | A | 2/1949 | Passman | |
| 3,399,708 | A | 9/1968 | Usher et al. | |
| RE29,621 | E | 5/1978 | Conley et al. | |
| 4,102,149 | A | 7/1978 | Conley et al. | |
| 4,222,641 | A * | 9/1980 | Stolov | 353/84 |
| 4,313,309 | A * | 2/1982 | Lehman, Jr. | 62/175 |
| 4,679,411 | A | 7/1987 | Pearse, Jr. | |
| 4,787,211 | A | 11/1988 | Shaw | |
| 4,951,475 | A | 8/1990 | Alsenz | |
| 5,079,929 | A | 1/1992 | Alsenz | |
| 5,095,712 | A | 3/1992 | Narreau | |
| 5,203,179 | A | 4/1993 | Powell | |
| 5,205,130 | A | 4/1993 | Pannell | |
| 5,241,829 | A * | 9/1993 | Irie et al. | 62/79 |

(Continued)

FOREIGN PATENT DOCUMENTS

DE 102 24 754 A1 12/2003

(Continued)

OTHER PUBLICATIONS

Thermofisher Scientific; set of photographs and refrigeration circuit diagram depicting an insulated enclosure supported within the deck of an ultra-low temperature freezer ("ULT") manufactured and sold by Jouan; 12 pages.

(Continued)

*Primary Examiner* — Mohammad Ali

(74) *Attorney, Agent, or Firm* — Wood, Herron & Evans, LLP

(57) ABSTRACT

A refrigeration system is provided for use with an ultra-low temperature freezer having a deck and a refrigerated cabinet supported above the deck. The system has a first refrigeration stage and a second refrigeration stage. The first stage defines a first fluid circuit for circulating a first refrigerant. The first stage has a first compressor, a condenser and a first expansion device that is in fluid communication with the first fluid circuit. The second stage defines a second fluid circuit for circulating a second refrigerant. The second stage has a second compressor, a second expansion device and an evaporator that is in fluid communication with the second fluid circuit. The system includes an insulated enclosure supported within the deck and a split-flow heat exchanger that is in fluid communication with the first and second fluid circuits and which is located within the insulated enclosure.

35 Claims, 6 Drawing Sheets

U.S. PATENT DOCUMENTS

| | | | | |
|---|---|---|---|---|
| 5,253,483 | A | 10/1993 | Powell et al. | |
| 5,255,529 | A | 10/1993 | Powell et al. | |
| 5,265,434 | A | 11/1993 | Alsenz | |
| 5,323,618 | A * | 6/1994 | Yoshida et al. | 62/149 |
| 5,335,507 | A | 8/1994 | Powell | |
| 5,575,329 | A * | 11/1996 | So et al. | 165/167 |
| 5,586,444 | A | 12/1996 | Fung | |
| 5,694,780 | A | 12/1997 | Alsenz | |
| 5,927,088 | A | 7/1999 | Shaw | |
| 6,119,472 | A * | 9/2000 | Ross | 62/228.2 |
| 6,131,401 | A * | 10/2000 | Ueno et al. | 62/175 |
| 6,167,621 | B1 * | 1/2001 | Goth et al. | 29/890.054 |
| 6,213,194 | B1 * | 4/2001 | Chrysler et al. | 165/80.3 |
| 6,237,356 | B1 | 5/2001 | Hori et al. | |
| 6,327,867 | B1 | 12/2001 | Hyodo et al. | |
| 6,405,554 | B1 * | 6/2002 | Kawakatu et al. | 62/335 |
| 6,453,691 | B1 | 9/2002 | Seo et al. | |
| 6,460,355 | B1 * | 10/2002 | Trieskey | 62/175 |
| 6,494,054 | B1 * | 12/2002 | Wong et al. | 62/335 |
| 6,595,009 | B1 * | 7/2003 | Howard et al. | 62/79 |
| 6,766,652 | B2 * | 7/2004 | Kelly et al. | 62/199 |
| 6,986,262 | B2 | 1/2006 | Takasugi et al. | |
| 7,055,588 | B2 * | 6/2006 | Nickolay et al. | 165/167 |
| 7,096,681 | B2 | 8/2006 | Wills et al. | |
| 7,193,826 | B2 | 3/2007 | Crane et al. | |
| 7,207,183 | B2 | 4/2007 | Crane et al. | |
| 7,231,773 | B2 | 6/2007 | Crane et al. | |
| 7,310,953 | B2 | 12/2007 | Pham et al. | |
| 7,587,911 | B2 * | 9/2009 | Yanik et al. | 62/515 |
| 2001/0030043 | A1 * | 10/2001 | Gleisle et al. | 165/167 |
| 2004/0118139 | A1 | 6/2004 | Kelly et al. | |
| 2005/0252226 | A1 | 11/2005 | Seefeldt | |
| 2006/0207279 | A1 * | 9/2006 | Daddis et al. | 62/255 |
| 2006/0207280 | A1 * | 9/2006 | Avila et al. | 62/255 |
| 2006/0210396 | A1 * | 9/2006 | Mead et al. | 415/213.1 |
| 2006/0213215 | A1 * | 9/2006 | Hirano et al. | 62/352 |
| 2006/0225445 | A1 | 10/2006 | Lifson et al. | |
| 2007/0125514 | A1 * | 6/2007 | Horn et al. | 165/42 |
| 2007/0125527 | A1 * | 6/2007 | Flik et al. | 165/140 |
| 2007/0156032 | A1 | 7/2007 | Gordon et al. | |
| 2007/0276637 | A1 | 11/2007 | Allen et al. | |
| 2008/0014097 | A1 | 1/2008 | Hase et al. | |
| 2008/0041076 | A1 | 2/2008 | Tutunoglu et al. | |
| 2008/0156031 | A1 | 7/2008 | Cur et al. | |
| 2009/0071189 | A1 * | 3/2009 | Martins et al. | 62/506 |
| 2009/0126901 | A1 | 5/2009 | Hegar et al. | |
| 2009/0133412 | A1 * | 5/2009 | Narayanamurthy et al. | 62/66 |

FOREIGN PATENT DOCUMENTS

| | | | |
|---|---|---|---|
| GB | 2 180 921 | A | 4/1987 |
| WO | 2009/062739 | A1 | 5/2009 |

OTHER PUBLICATIONS

Thermofisher Scientific; set of photographs and refrigeration circuit diagram depicting an insulated enclosure supported within the deck of an ultra-low temperature freezer ("ULT") manufactured and sold by Jouan and commercially available from Jouan more than one year prior to the filing date of the present application (12 pages).

European Patent Office, International Search Report and Written Opinion of the International Searching Authority, International Application No. PCT/US2010/050694, mailed May 23, 2011 (11 pages).

* cited by examiner

REFRIGERATION SYSTEM MOUNTED WITHIN A DECK

FIELD OF THE INVENTION

The present invention relates generally to refrigeration systems and, more particularly, to refrigeration systems for use with ultra-low temperature freezers.

BACKGROUND OF THE INVENTION

Refrigeration systems are known for use with freezers of the type known as "ultra-low temperature freezers" ("ULT's"), which are used to cool their interior storage spaces to relative low temperatures such as about −80° C. or lower, for example.

Known refrigeration systems of this type include two stages circulating respective first and second refrigerants. The first stage transfers energy (i.e., heat) from the first refrigerant to the surrounding environment through a condenser, while the second refrigerant of the second stage receives energy from the cooled space (e.g., a cabinet interior) through an evaporator. Heat is transferred from the second refrigerant to the first refrigerant through a heat exchanger that is in fluid communication with the two stages of the refrigeration system.

In refrigeration systems of the type described above, the heat exchanger may be of a single-pass, coiled type. Heat exchangers of this type, however, typically occupy large spaces to permit the desired type of heat exchange between the refrigerants. The space and orientation requirements for these heat exchangers force designers to place them alongside or behind the walls of the inner freezer chamber, in front of the outer freezer cabinet, typically taking up valuable cooling/storage space thus not available for cooling.

In addition to the above, the attainable efficiency of these heat exchangers is limited by the relatively small amount of insulation that can be arranged around them between the walls of the inner freezer chamber and the outer freezer cabinet. Specifically, a relative small amount of insulation is placed around a heat exchanger of a refrigeration system of this type in order to minimize the amount of cooling/storage space that is lost to the heat exchanger.

There is a need, therefore, for refrigeration systems for use with ultra-low temperature freezers that can operate with a relative large efficiency, and which permit maximization of the cooling/storage space of the freezer.

SUMMARY OF THE INVENTION

In one embodiment, a refrigeration system is provided for use with an ultra-low temperature freezer having a deck and a refrigerated cabinet supported above the deck. The system has a first refrigeration stage and a second refrigeration stage. The first stage defines a first fluid circuit for circulating a first refrigerant. The first stage has a first compressor, a condenser, and a first expansion device that is in fluid communication with the first fluid circuit. The second stage defines a second fluid circuit for circulating a second refrigerant. The second stage has a second compressor, a second expansion device, and an evaporator that is in fluid communication with the second fluid circuit. The system includes an insulated enclosure supported within the deck and a split-flow heat exchanger that is in fluid communication with the first and second fluid circuits and which is located within the insulated enclosure.

In one embodiment, the heat exchanger may have a plurality of stacked plates that define flow paths for the first and second refrigerants through the heat exchanger. In a specific embodiment, the heat exchanger is in the form of a brazed plate heat exchanger. The heat exchanger may be oriented within the insulated enclosure such that a longitudinal dimension thereof is oriented generally vertical. The first refrigerant may enter the heat exchanger proximate a lower portion thereof and exit the heat exchanger proximate an upper portion thereof, such that the first refrigerant flows generally in an upward direction within the heat exchanger. Additionally, or alternatively, the second refrigerant may enter the heat exchanger proximate an upper portion thereof and exit the heat exchanger proximate a lower portion thereof, such that the second refrigerant flows generally in a downward direction within the heat exchanger.

In specific embodiments, the heat exchanger is of a counter-flow type. Also, the first expansion device may be located within the insulated enclosure. Additionally, the first expansion device may include at least one of a capillary tube or a valve. The first refrigeration stage may have a first accumulator that is in fluid communication with the first fluid circuit. The first accumulator may, for example, be located within the insulated enclosure. The first refrigeration stage may have a first filter/dryer that is in fluid communication with the first fluid circuit and which is supported within the deck. The first filter/dryer is, in some embodiments, located outside of the insulated enclosure. The second expansion device may be located outside the insulated enclosure. Additionally or alternatively, the second expansion device may include at least one of a capillary tube or a valve. The second refrigeration stage, in specific embodiments, has a second accumulator that is in fluid communication with a second fluid circuit. The second accumulator may, for example, be located outside of the insulated enclosure. Alternatively, the second accumulator may be located inside the insulated enclosure.

In another embodiment, a refrigeration system is provided for use with an ultra-low temperature freezer having a deck and a refrigerated cabinet supported above the deck. The system includes a first refrigeration stage and a second refrigeration stage. The first stage defines a first fluid circuit for circulating a first refrigerant, with the first stage having a first compressor, a condenser, a first filter/dryer, a first expansion device, and a first accumulator that is in fluid communication with the first fluid circuit. The second stage defines a second fluid circuit for circulating a second refrigerant, and has a second compressor, a second filter/dryer, a second expansion device, an evaporator, and a second accumulator that is in fluid communication with the second fluid circuit. The system also includes an insulated enclosure that is supported within the deck, and a split-flow heat exchanger that is in fluid communication with the first and second fluid circuits. The heat exchanger, the expansion device, the first accumulator, and the second filter/dryer are located within the insulated enclosure.

In yet another embodiment, an ultra-low temperature freezer is provided having a deck, a refrigerated cabinet supported above the deck, and a refrigeration system that is in thermal communication with the refrigerated cabinet. The refrigeration system includes a first refrigeration stage defining a first fluid circuit for circulating the first refrigerant, with the first stage having a first compressor, a condenser, and a first expansion device that is in fluid communication with the first fluid circuit. The system also includes a second refrigeration stage that defines a second fluid circuit for circulating a second refrigerant, with the second stage having a second compressor, a second expansion device, and an evaporator that is in fluid communication with the second fluid circuit. An insulated enclosure of the refrigeration system is supported within the deck, and a split-flow heat exchanger is in fluid communication with the first and second fluid circuits and is located within the insulated enclosure.

In another embodiment, a method is provided for operating an ultra-low temperature freezer. The method includes circulating a first refrigerant through a first compressor, a condenser, and a first expansion device of a first stage of a refrigeration system. A second refrigerant is circulated through a second compressor, a second expansion device, and an evaporator of a second stage of the system. A stream of at least one of the first or second refrigerants is split within a deck of the freezer into a plurality of streams that are arranged relative to one or more streams of the other of the first or second refrigerants so as to exchange heat between the first and second refrigerants. The method includes rejoining the plurality of streams and supporting a refrigerated cabinet of the freezer above the deck.

The method, in a specific embodiment, includes directing the stream of the at least one of the first or second refrigerants along a plurality of generally parallel streams. The method may be such that splitting the stream of the at least one of the first or second refrigerants includes turbulently flowing the at least one of the first or second refrigerants. Additionally or alternatively, splitting the stream of the at least one of the first or second refrigerants includes directing the at least one of the first or second refrigerants along a plurality of parallel plates that are spaced from one another. The method may include flowing the first refrigerant in a generally upward direction and/or flowing the second refrigerant in a generally downward direction.

In a specific embodiment, the method includes accumulating a liquid form of the first refrigerant or a liquid form of the second refrigerant within an insulated enclosure that concurrently insulates the plurality of streams. The method may include expanding the first refrigerant or the second refrigerant within one of a valve or a capillary tube.

Accordingly, the system and related methods described herein, by having a heat exchanger in the deck of the freezer, allows the positioning of adequate quantities of insulation around the heat exchanger, thereby attaining higher efficiencies than observed with conventional ultra-low temperature freezers. Moreover, having the heat exchanger in the deck of the freezer allows for maximization of the cabinet interior space above the deck.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
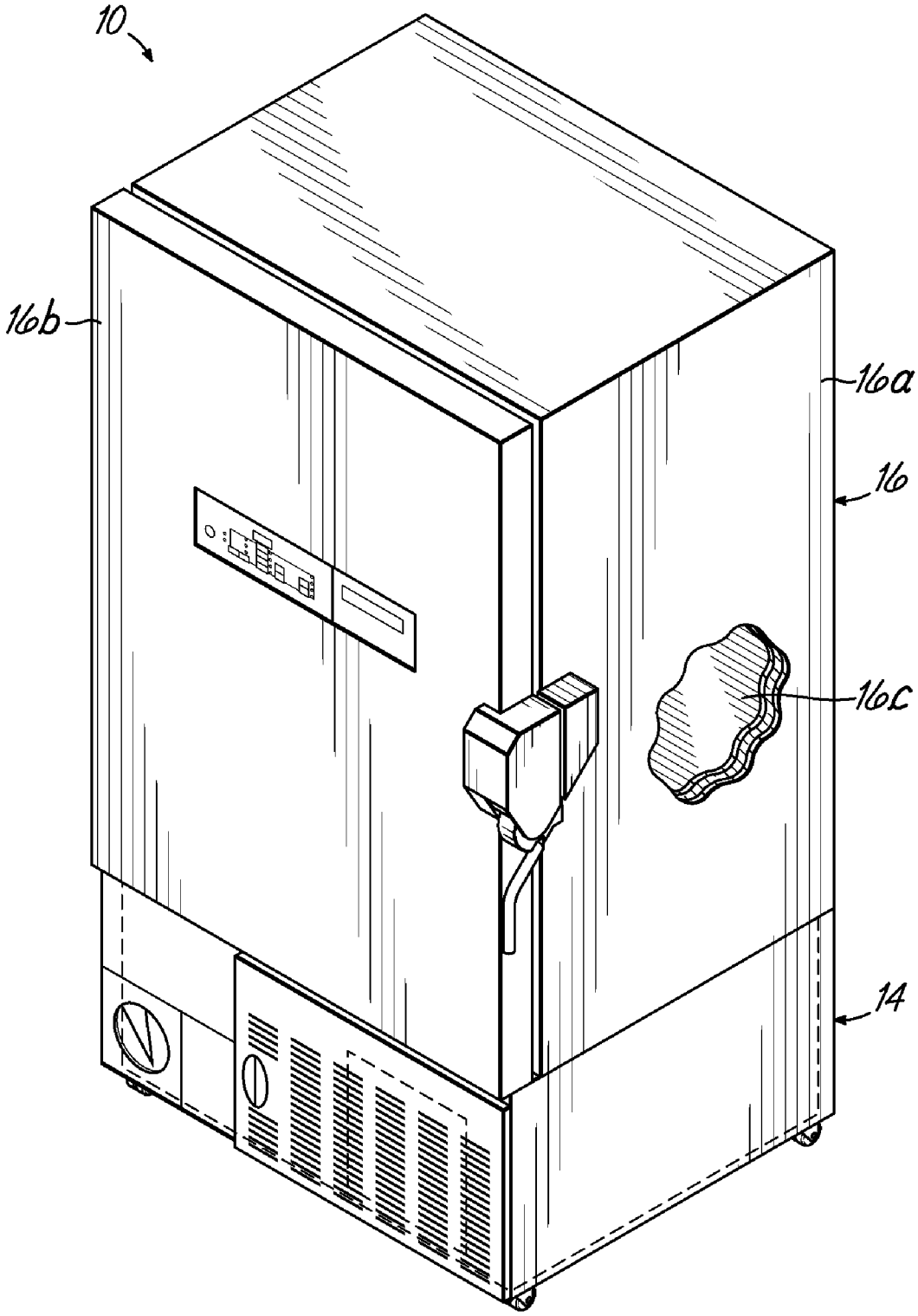
FIG. 1 is a partially broken perspective view of an ultra-low temperature freezer in accordance with an embodiment of the invention.
Figure 2:
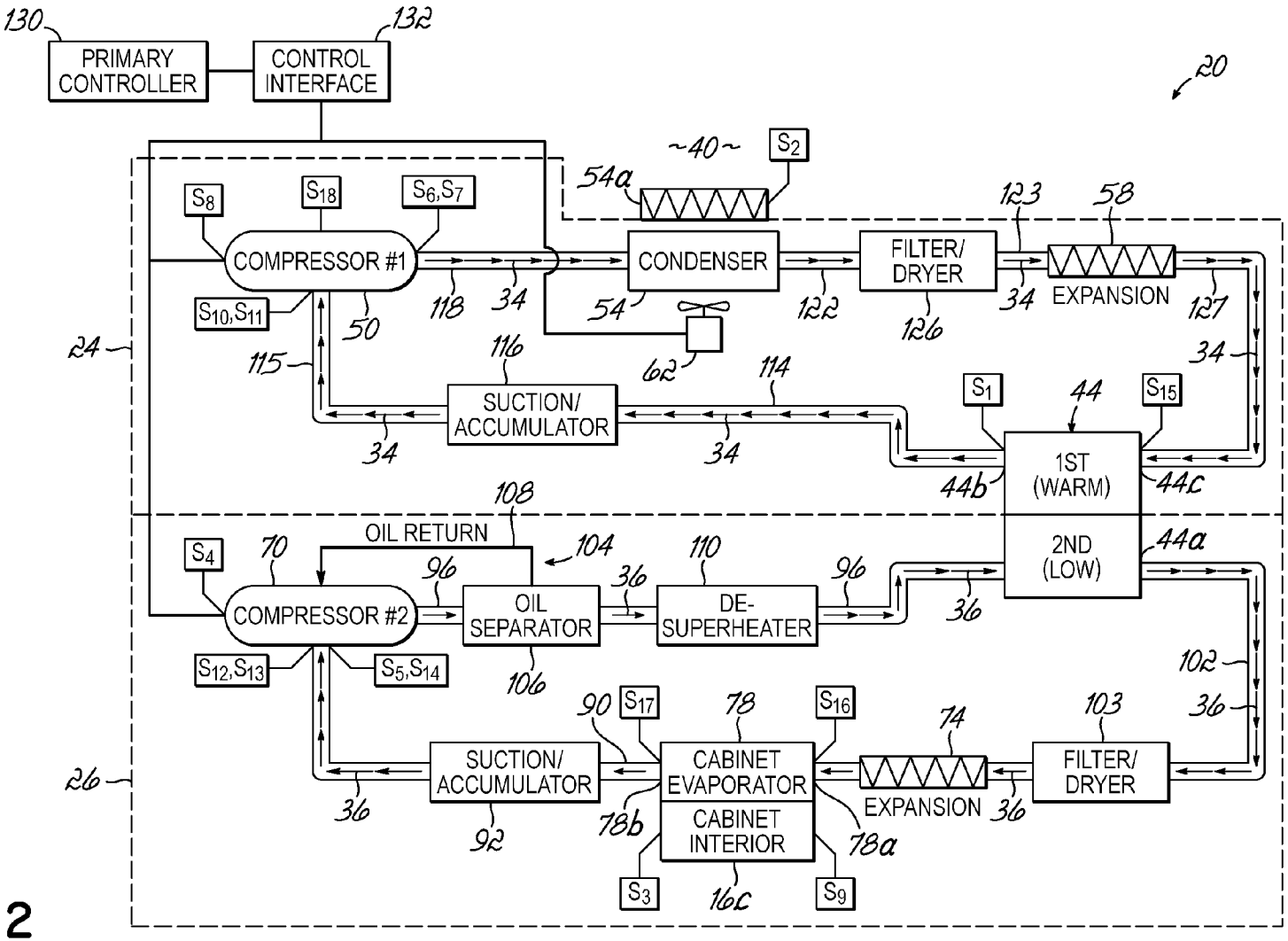
FIG. 2 is a schematic representation of the refrigeration system used with the freezer of FIG. 1.
Figure 3:
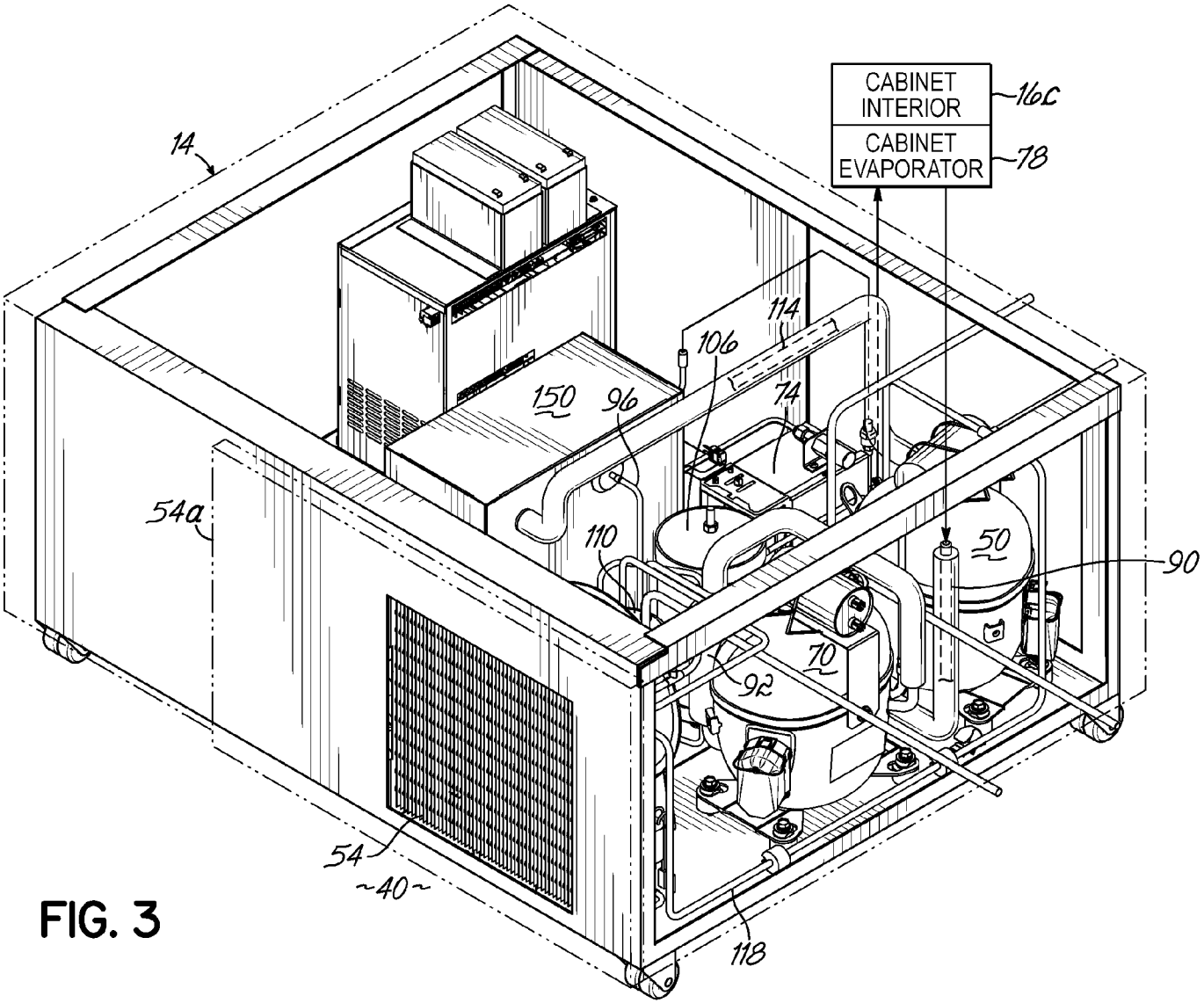
FIG. 3 is a perspective view of a deck of the freezer of FIG. 1.
Figure 4:
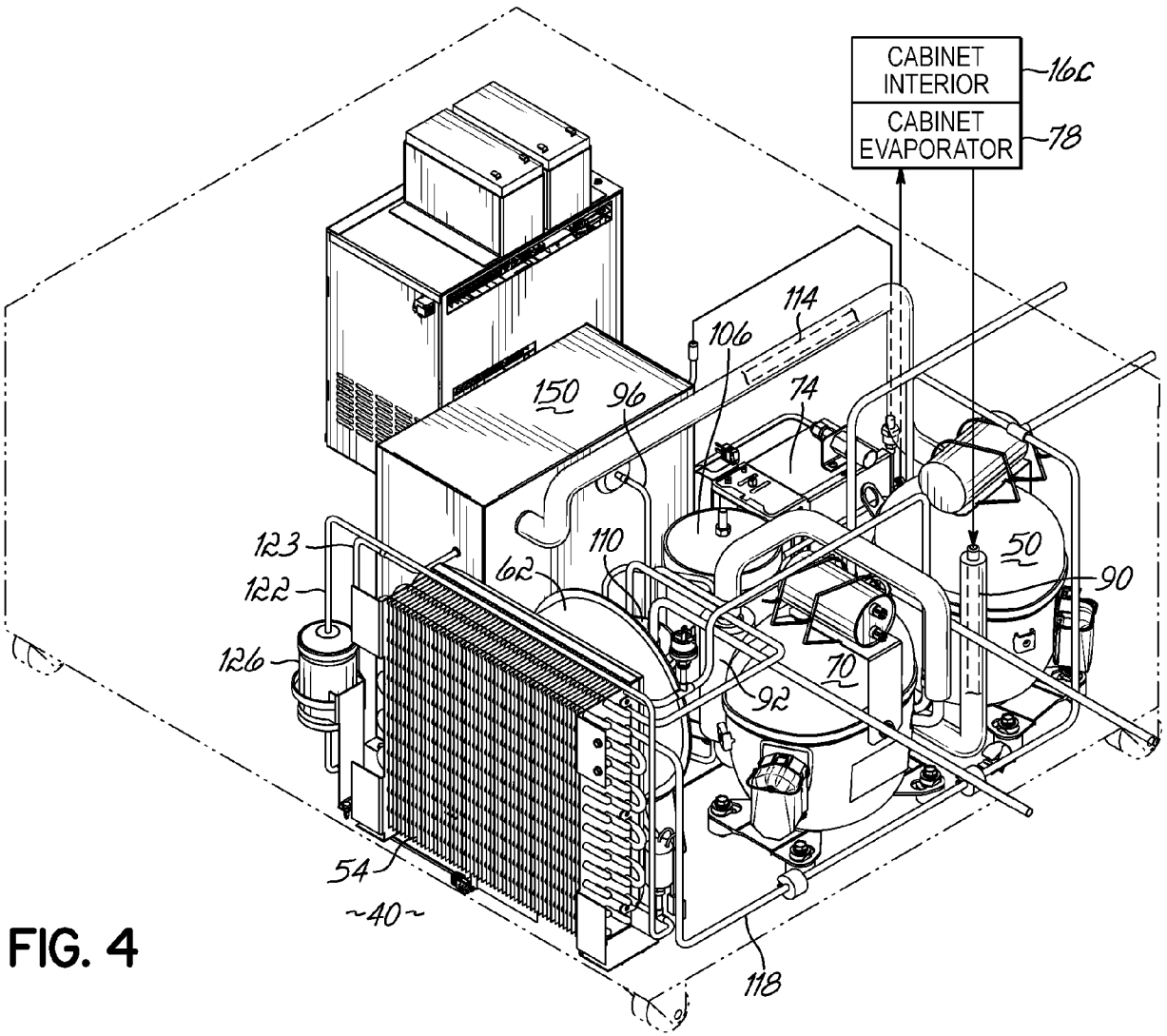
FIG. 4 is a perspective view illustrating an interior portion of the deck of FIG. 3.
Figure 5:
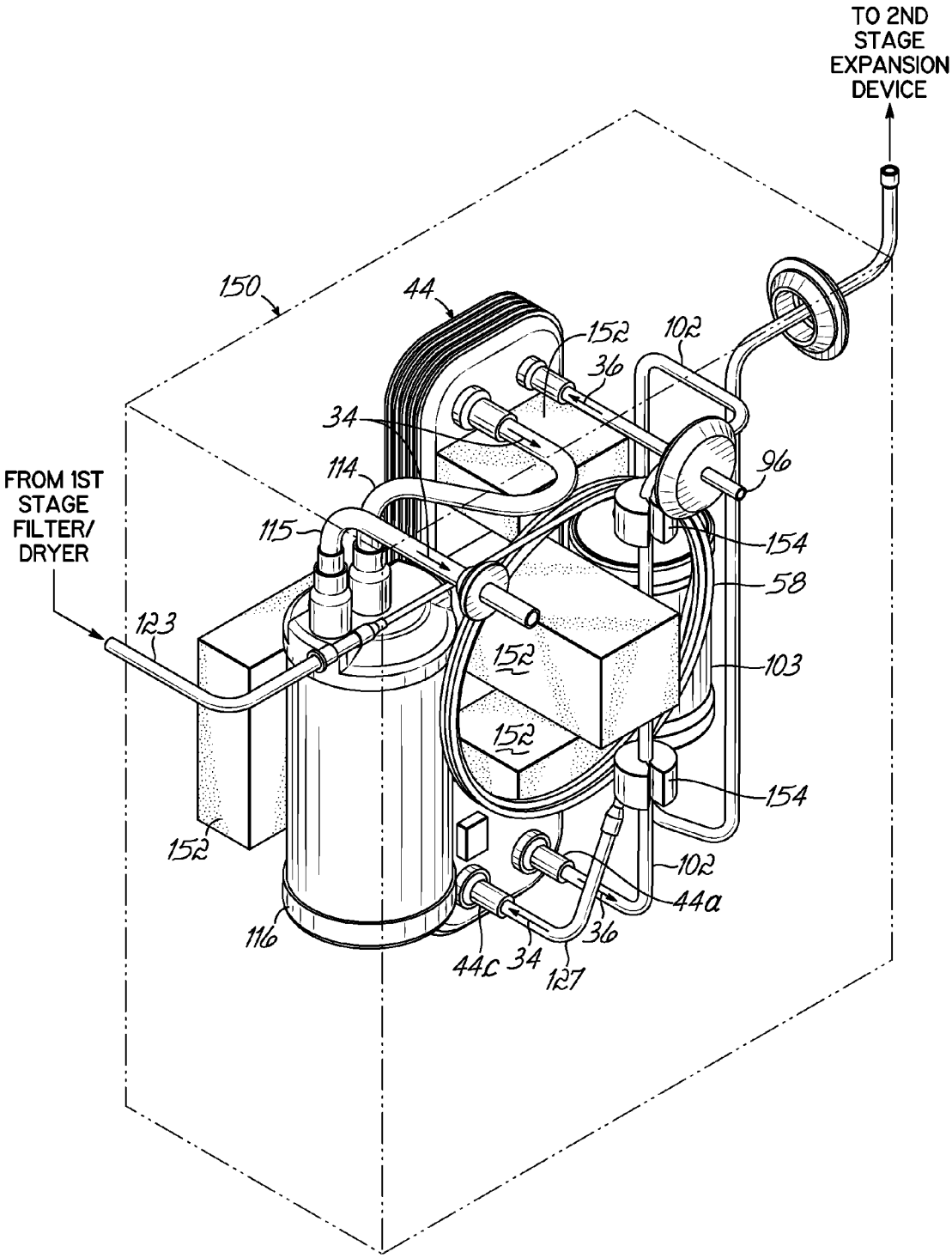
FIG. 5 is a perspective view of an interior portion of an insulated enclosure within the deck of FIGS. 3-4.

With reference to the figures, and more specifically to FIG. 1, an exemplary refrigeration unit according to one embodiment of the present invention is illustrated. The unit of FIG. 1 is in the form of an ultra-low temperature freezer ("ULT") 10 having a deck 14 that supports a cabinet 16 thereabove, for storing items that require cooling to temperatures of about −80° C. or lower, for example. The cabinet 16, in turn, includes a cabinet housing 16*a* and a door 16*b* providing access into an interior 16*c* of the cabinet 16. The deck 14 supports one or more components that jointly define a two-stage cascade refrigeration system 20 (FIG. 2) that thermally interacts with cabinet 16 to cool the interior 16*c* thereof. As used herein, the term "deck" refers to the structural assembly or framework that is located beneath and supports the cabinet 16. An exemplary refrigeration system similar to system 20 is described in U.S. patent application Ser. No. 12/570,348, entitled REFRIGERATION SYSTEM HAVING A VARIABLE SPEED COMPRESSOR, assigned to the assignee of the present application, and filed concurrently herewith. The disclosure of this commonly-assigned application is incorporated by reference herein in its entirety.

With reference to FIGS. 2-5, details of the exemplary refrigeration system 20 are illustrated. System 20 is made up of a first stage 24 and a second stage 26 respectively defining first and second circuits for circulating a first refrigerant 34 and a second refrigerant 36. A plurality of sensors $S_1$ through $S_{18}$ are arranged to sense different conditions of system 20 and/or properties of the refrigerants 34, 36 in system 20, while a controller 130 accessible through a controller interface 132, permit controlling of the operation of system 20. The first stage 24 transfers energy (i.e., heat) from the first refrigerant 34 to the surrounding environment 40, while the second refrigerant 36 of the second stage 26 receives energy from the a cabinet interior 16*c*. Heat is transferred from the second refrigerant 36 to the first refrigerant 34 through a heat exchanger 44 (FIG. 5) that is in fluid communication with the first and second stages 24, 26 of the refrigeration system 20.

The first stage 24 includes, in sequence, a first compressor 50, a condenser 54, and a first expansion device 58. A fan 62 directs ambient air across the condenser 54 through a filter 54*a* and facilitates the transfer of heat from the first refrigerant 34 to the surrounding environment 40. The second stage 26 includes, also in sequence, a second compressor 70, a second expansion device 74, and an evaporator 78. The evaporator 78 is in thermal communication with the interior 16*c* of cabinet 16 (FIG. 1) such that heat is transferred from the interior 16*c* to the evaporator 78, thereby cooling the interior 16*c*. The heat exchanger 44 is in fluid communication with the first stage 24 between the first expansion device 58 and the first compressor 50. Further, the heat exchanger 44 is in fluid communication with the second stage 26 between the second compressor 70 and the second expansion device 74. In general, the first refrigerant 34 is condensed in the condenser 54 and remains in liquid phase until it evaporates at some point within the heat exchanger 44. First refrigerant vapor is compressed by first compressor 50 before being returned to condenser 54.

In operation, the second refrigerant 36 receives heat from the interior 16*c* through the evaporator 78 and flows from the evaporator 78 to the second compressor 70 through a conduit 90. An accumulator device 92 is in fluid communication with conduit 90 to pass the second refrigerant 36 in gaseous form to the second compressor 70, while accumulating excessive amounts of the same in liquid form and feeding it to the second compressor 70 at a controlled rate. From the second compressor 70, the compressed second refrigerant 36 flows through a conduit 96 and into the heat exchanger 44 thermally communicating the first and second stages 24, 26 with one another. The second refrigerant 36 enters the heat exchanger 44 in gas form and transfers heat to the first refrigerant 34 while condensing into a liquid form. In this regard, the flow of the first refrigerant 34 may, for example, be counter-flow relative to the second refrigerant 36, so as to maximize the rate of heat transfer. In one specific, non-limiting example, the heat exchanger 44 is in the form of a split-flow brazed plate heat exchanger, vertically oriented within the deck 14 (FIG. 1), and designed to maximize the amount of turbulent flow of the first and second refrigerants 34, 36 within heat exchanger 44, which in turn maximizes the heat transfer from the second refrigerant 36 to the first refrigerant 34. Other types or configurations of heat exchangers are possible as well.

With continued reference to FIGS. 2-5, the second refrigerant 36 exits the heat exchanger 44, in liquid form, through an outlet 44*a* thereof and flows through a conduit 102, through a filter/dryer unit 103, then through the second expansion device 74, and then back to the evaporator 78 of the second stage 26 where it can evaporate into gaseous form while absorbing heat from the cabinet interior 16*c*. The second stage 26 of this exemplary embodiment also includes an oil loop 104 for lubricating the second compressor 70. Specifically, the oil loop 104 includes an oil separator 106 in fluid communication with conduit 96 and an oil return line 108 directing oil back into second compressor 70. Additionally, or alternatively, the second stage 26 may include a de-superheater device 110 to cool down the discharge stream of the second refrigerant 36 and which is in fluid communication with conduit 96 upstream of the heat exchanger 44.

As discussed above, the first refrigerant 34 flows through the first stage 24. Specifically, the first refrigerant 34 receives heat from the second refrigerant 36 flowing through the heat exchanger 44, leaves the heat exchanger 44 in gas form through an outlet 44*b* thereof and flows along a pair of conduits 114, 115 towards the first compressor 50. An accumulator device 116 is positioned between conduits 114 and 115 to pass the first refrigerant 34 in gaseous form to the first compressor 50, while accumulating excessive amounts of the same in liquid form and feeding it to the first compressor 50 at a controlled rate. From the first compressor 50, the compressed first refrigerant 34 flows through a conduit 118 and into the condenser 54. The first refrigerant 34 in condenser 54 transfers heat to the surrounding environment 40 as it condenses from gaseous to liquid form, before flowing along conduits 122, 123, through a filter/dryer unit 126, and into the first expansion device 58, where the first refrigerant 34 undergoes a pressure drop. From the first expansion device 58, the first refrigerant 34 flows through a conduit 127 back into the heat exchanger 44, entering the same in liquid form.

With continued reference to FIGS. 2-5, an exemplary insulated enclosure 150 supported within the deck 14 encloses one or more of the components described above, permitting sufficient insulation of those components which, in turn, improves the efficiency of the system 20 relative to conventional refrigeration systems. Specifically, the heat exchanger 44 is supported within the insulated enclosure 150 and is surrounded by sufficient amounts of insulation 152 so as to enable attainment of a desired level of efficiency of the heat exchanger 44. Moreover, a plurality of isolators 154, such as foam blocks, prevents contact between conduits within enclosure 150 in selected locations and positions the conduits and other components when the enclosure 150 is being foamed.

In this exemplary embodiment, the heat exchanger 44 is oriented generally vertically and further such that the first refrigerant 34 flows in a generally upward direction while the second refrigerant 36 flows in a generally downward direction. More specifically, the first refrigerant 34 enters the heat exchanger 44 proximate a lower portion thereof and exits the same proximate an upper portion of the heat exchanger 44. Similarly, the second refrigerant 36 enters the heat exchanger 44 proximate an upper portion thereof and exits the same proximate a lower portion of the heat exchanger 44. As discussed above, the first refrigerant 34 evaporates from a liquid to a gaseous form in heat exchanger 44, while the second refrigerant 36 condenses from a gaseous to a liquid form in heat exchanger 44.

In the exemplary embodiment of FIGS. 2-5, moreover, the insulated enclosure 150 supports within its interior the first expansion device 58 of the first stage 24. In this embodiment, the first expansion device 58 is in the form of a capillary tube, although it is contemplated that it could instead take another form such as, and without limitation, an expansion valve (not shown). In addition to the first expansion device 58, the accumulator device 116 of the first stage 24 is also supported within the interior of insulated enclosure 150, as is the filter/dryer unit 103 of the second stage 26. Those of ordinary skill in the art will readily appreciate that other components of system 20 may be located inside the insulated enclosure 150 alternatively or in addition to those components located inside the enclosure 150 in the illustrated embodiment.

Among the factors which one skilled in the art can use in deciding which components to include within enclosure 150 are the expecting operating temperature of the specific component under steady state operating conditions, taking into account the boiling points and other characteristics of first refrigerant 34 and second refrigerant 36, the desired temperature at which cabinet interior 16*c* is to be maintained, various operating pressures and similar factors. For example, in ULT freezers with an expected cabinet temperature of about −86° C. and certain common refrigerants, the heat exchanger 44 is expected to operate under steady state conditions at about −40° C. Exemplary refrigerants suitable for the presently described embodiments include refrigerants commercially available under the respective designations R404A for the first refrigerant 34, and a mixture of R290 and R508B for the second refrigerant 36. Moreover, in specific embodiments, the first and second refrigerants may be combined with an oil to facilitate lubrication of the respective compressors 50, 70. For example, and without limitation, the first refrigerant 34 may be combined with Mobil EAL Artic 32 oil and the second refrigerant 36 may be combined with Zerol 150 Alkylbenzene oil. In another aspect of the present disclosure, the precise arrangement of the components illustrated in the figures is intended to be merely exemplary rather than limiting.

Figure 6:
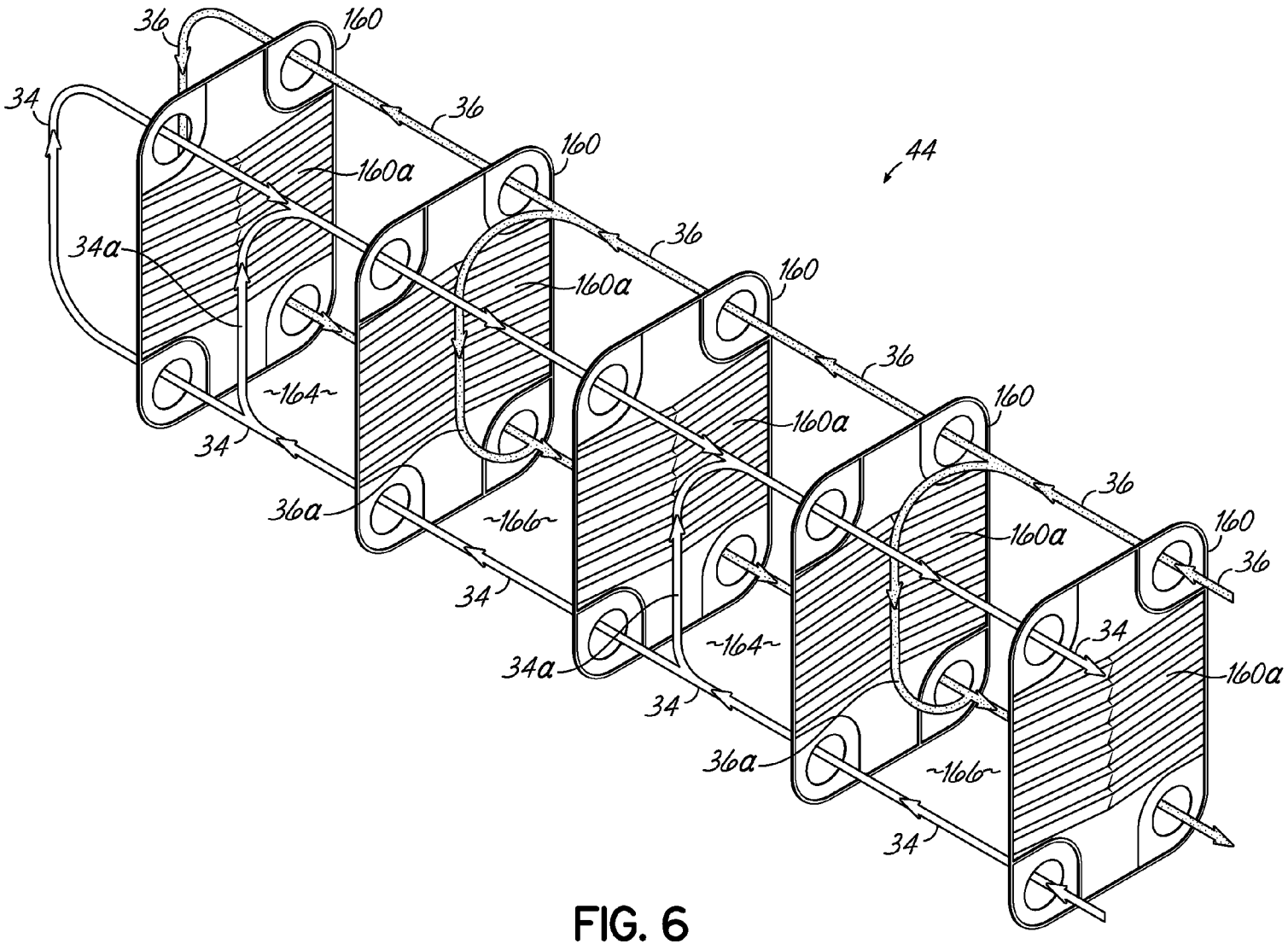
FIG. 6 is a schematic, disassembled view illustrating the flow of first and second refrigerants through an exemplary heat exchanger of the system of FIG. 2.

As discussed above, the heat exchanger 44 of the embodiment of FIGS. 2-5 is located within the deck 14, and more specifically within the insulated enclosure 150. One exemplary heat exchanger suitable for use in the present invention is the Model #B3-C30-14-30-HQ-Q1Q2Q3(H1/4D)/Q4 (H38D) brazed plate heat exchanger commercially available from Danfoss A/S of Nordborgvej, Denmark. The heat exchanger 44 illustrated in the figures is arranged such that a plurality of generally parallel streams 34*a* of the first refrigerant 34 and a plurality of generally parallel streams 36*a* of the second refrigerant 36 are directed through the heat exchanger 44, in counter-flow fashion, to permit the exchange of heat between the first and second refrigerants 34, 36, as illustrated in FIG. 6. To this end, the exemplary heat exchanger 44 is in the form of a split-flow, brazed plate heat exchanger that includes a plurality of stacked flat plates 160 that are spaced from one another and each having on one or both of its planar surfaces a series of channels 160*a*.

Each of the respective volumes between adjacent plates 160 defines a chamber 164, 166, within which one of the refrigerants 34, 36 flows. Further, the chambers 164, 166 are arranged in alternating fashion i.e., such that two adjacent chambers 164, 166 respectively receive the flow of two different refrigerants 34, 36. Under normal conditions, it is expected that each channel 164 will have liquid first refrigerant 34 adjacent to its base which evaporates as first refrigerant 34 moves upwardly. Under normal conditions, it is expected that each channel 166 will have gaseous second refrigerant 36 adjacent to its top which condenses as second refrigerant 36 moves downwardly. The levels for liquid refrigerant and for mixed liquid/gas refrigerant may vary between channels 164 and channels 166 and may also vary among parallel channels 164 and among parallel channels 166. Controls (not shown) can be used to minimize the situations in which particular channels 164 or 166 are occupied either entirely by gaseous refrigerant or entirely by liquid refrigerant, except during start-up of the system.

In one aspect of the exemplary heat exchanger 44, the shapes of the channels 160*a* on the plates 160 are chosen so as to facilitate the generation of turbulent flow within the heat exchanger 44, which in turn maximizes the level of heat transfer between the refrigerants 34, 36. For example, and without limitation, the channels 160*a* may be chevron-shaped or be formed as pleats of corrugated plates. As used herein, the term "split-flow" heat exchanger refers to a heat exchanger that splits at least one of the first or second refrigerant streams from a single stream into a plurality of streams that are eventually rejoined into a single fluid stream.

While the exemplary heat exchanger 44 is arranged to receive there through respective pluralities of streams of the first and second refrigerants 34, 36, it is contemplated that, alternatively, a different type of split-flow heat exchanger 44 may be arranged such that only one of the refrigerants 34 or 36 may flow in multiple streams relative to the other refrigerant 36 or 34, respectively. For example and without limitation, alternative split-flow heat exchangers 44 may take the form of tube-and-shell heat exchangers, fin-plate heat exchangers, or other types of heat exchangers arranged to permit the flow of at least one of the refrigerants 34, 36 in a plurality of streams in a counter-flow, cross-flow, or parallel-flow arrangement. The use of any of these alternative types of heat exchangers 44 is deemed to fall within the scope of the present disclosure. Further, the exemplary heat exchanger 44 illustrated in FIG. 6 permits the flow of multiple streams of the first refrigerant 34 that are generally parallel to one another, and the flow of multiple streams of the second refrigerant 36 that are also parallel to one another. This type of flow within the split-flow heat exchanger 44 is intended to be exemplary rather than limiting.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A refrigeration system for use with an ultra-low temperature freezer having a deck and a refrigerated cabinet supported above the deck, comprising:

a first refrigeration stage defining a first fluid circuit for circulating a first refrigerant, the first refrigeration stage having a first compressor, a condenser, and a first expansion device in fluid communication with the first fluid circuit;

a second refrigeration stage defining a second fluid circuit for circulating a second refrigerant, the second refrigeration stage having a second compressor, a second expansion device and an evaporator in fluid communication with the second fluid circuit;

an insulated enclosure supported within the deck; and a split-flow heat exchanger in fluid communication with the first and second fluid circuits and located within the insulated enclosure.

2. The refrigeration system of claim 1, wherein the split-flow heat exchanger comprises a plurality of stacked plates that define flow paths for the first and second refrigerants through the heat exchanger.

3. The refrigeration system of claim 2, wherein the heat exchanger comprises a brazed plate heat exchanger.

4. The refrigeration system of claim 1, wherein a longitudinal dimension of the split-flow heat exchanger is oriented vertically within the insulated enclosure.

5. The refrigeration system of claim 4, wherein the first refrigerant enters the split-flow heat exchanger proximate a lower portion thereof and exits the split-flow heat exchanger proximate an upper portion thereof so that the first refrigerant flows generally in an upward direction within the split-flow heat exchanger.

6. The refrigeration system of claim 5, wherein the second refrigerant enters the split-flow heat exchanger proximate an upper portion thereof and exits the split-flow heat exchanger proximate a lower portion thereof so that the second refrigerant flows generally in a downward direction within the split-flow heat exchanger.

7. The refrigeration system of claim 1, wherein the split-flow heat exchanger is of a counter-flow type.

8. The refrigeration system of claim 1, wherein the first expansion device is located within the insulated enclosure.

9. The refrigeration system of claim 8, wherein the first expansion device includes at least one of a capillary tube or a valve.

10. The refrigeration system of claim 1, wherein the first refrigeration stage further has a first accumulator in fluid communication with the first fluid circuit.

11. The refrigeration system of claim 10, wherein the first accumulator is located within the insulated enclosure.

12. The refrigeration system of claim 1, wherein the first refrigeration stage further has a first filter/dryer in fluid communication with the first fluid circuit and supported within the deck.

13. The refrigeration system of claim 12, wherein the first filter/dryer is located outside of the insulated enclosure.

14. The refrigeration system of claim 13, wherein the second expansion device is located outside of the insulated enclosure.

15. The refrigeration system of claim 14, wherein the second expansion device includes at least one of a capillary tube or a valve.

16. The refrigeration system of claim 1, wherein the second refrigeration stage further has a second accumulator in fluid communication with the second fluid circuit.

17. The refrigeration system of claim 16, wherein the second accumulator is located outside of the insulated enclosure.

18. The refrigeration system of claim 16, wherein the second accumulator is located inside the insulated enclosure.

19. A refrigeration system for use with an ultra-low temperature freezer having a deck and a refrigerated cabinet supported above the deck, comprising:

a first refrigeration stage defining a first fluid circuit for circulating a first refrigerant, the first refrigeration stage having a first compressor, a condenser, a first filter/dryer, a first expansion device, and a first accumulator in fluid communication with the first fluid circuit;

a second refrigeration stage defining a second fluid circuit for circulating a second refrigerant, the second refrigeration stage having a second compressor, a second filter/dryer, a second expansion device, an evaporator, and a second accumulator in fluid communication with the second fluid circuit;

an insulated enclosure supported within the deck; and a split-flow heat exchanger in fluid communication with the first and second fluid circuits, wherein the split-flow heat exchanger, the first expansion device, the first accumulator, and the second filter/dryer are located within the insulated enclosure.

20. The refrigeration system of claim 19, wherein the first filter/dryer is supported within the deck.

21. The refrigeration system of claim 20, wherein the first filter/dryer is located outside of the insulated enclosure.

22. The refrigeration system of claim 19, wherein the second expansion device is located outside of the insulated enclosure.

23. The refrigeration system of claim 22, wherein the second expansion device includes at least one of a capillary tube or a valve.

24. The refrigeration system of claim 20, wherein the second accumulator is located outside of the insulated enclosure.

25. The refrigeration system of claim 20, wherein the second accumulator is located inside the insulated enclosure.

26. An ultra-low temperature freezer, comprising:

a deck;

a refrigerated cabinet supported above the deck; and a refrigeration system in thermal communication with the refrigerated cabinet, the refrigeration system comprising:

a first refrigeration stage defining a first fluid circuit for circulating a first refrigerant, the first refrigeration stage having a first compressor, a condenser, and a first expansion device in fluid communication with the first fluid circuit;

a second refrigeration stage defining a second fluid circuit for circulating a second refrigerant, the second refrigeration stage having a second compressor, a second expansion device, and an evaporator in fluid communication with the second fluid circuit;

an insulated enclosure supported within the deck; and a split-flow heat exchanger in fluid communication with the first and second fluid circuits and located within the insulated enclosure.

27. A method of operating an ultra-low temperature freezer having a deck, a refrigerated cabinet supported above the deck, and an insulated enclosure within the deck, the method comprising:

circulating a first refrigerant through a first compressor, a condenser, and a first expansion device of a first stage of a refrigeration system;

circulating a second refrigerant through a second compressor, a second expansion device, and an evaporator of a second stage of the refrigeration system; and splitting within the insulated enclosure in the deck of the freezer a stream of at least one of the first or second refrigerants into a plurality of streams arranged relative to one or more streams of the other of the first or second refrigerants so as to exchange heat between the first and second refrigerants.

28. The method of claim 27, wherein splitting the stream of the at least one of the first or second refrigerants includes directing the at least one of the first or second refrigerants along a plurality of generally parallel streams.

29. The method of claim 27, wherein splitting the stream of the at least one of the first or second refrigerants includes turbulently flowing the at least one of the first or second refrigerants.

30. The method of claim 27, further comprising:

splitting respective streams of the first and second refrigerants along respective first and second pluralities of streams, the first and second pluralities being arranged relative to one another so as to exchange heat between the first and second refrigerants.

31. The method of claim 27, wherein splitting of the stream of the at least one of the first or second refrigerants includes directing the at least one of the first or second refrigerants along a plurality of parallel plates that are spaced from one another.

32. The method of claim 27, wherein splitting the stream of the at least one of the first or second refrigerants includes flowing the first refrigerant in a generally upward direction.

33. The method of claim 27, wherein splitting the stream of the at least one of the first or second refrigerants includes flowing the second refrigerant in a generally downward direction.

34. The method of claim 27, further comprising:

accumulating a liquid form of the first refrigerant or a liquid form of the second refrigerant within the insulated enclosure.

35. The method of claim 27, further comprising:

expanding the first refrigerant or the second refrigerant within one of a valve or a capillary tube.

* * * * *